United States Patent [19]

Wiley

[11] 4,389,049

[45] Jun. 21, 1983

[54] COMPENSATOR FOR BEAM OF BALANCE SCALE OF COUNTERFEIT COIN-IDENTIFICATION GAME

[76] Inventor: Roland H. Wiley, 2021 W. Charleston, Las Vegas, Nev. 89102

[21] Appl. No.: 331,202

[22] Filed: Dec. 16, 1981

[51] Int. Cl.[3] ..... A63F 9/06

[52] U.S. Cl. ..... 273/153 R; 177/50

[58] Field of Search ..... 273/153 R; 434/194; 177/50

[56] References Cited

U.S. PATENT DOCUMENTS

| | | | |
|---|---|---|---|
| 192,241 | 6/1877 | Doherty . | |
| 292,763 | 1/1884 | Purnelle | 177/51 |
| 645,185 | 3/1900 | Porter . | |
| 1,229,641 | 6/1917 | Munzner | 177/50 |
| 2,402,892 | 6/1946 | Hubble | 434/194 |
| 3,424,455 | 1/1969 | Dunson | 273/153 R |
| 3,567,221 | 3/1971 | Stults | 273/153 R X |
| 4,014,550 | 3/1977 | Wilcox | 273/153 R |
| 4,350,340 | 9/1982 | Hall | 273/153 R |
| 4,354,682 | 10/1982 | Vcala | 273/153 R |

FOREIGN PATENT DOCUMENTS

| | | | |
|---|---|---|---|
| 2129594 | 12/1972 | Fed. Rep. of Germany | 434/194 |
| 431623 | 5/1911 | France | 273/153 R |

OTHER PUBLICATIONS

"More Games for the Super-Intelligent" by James F. Fixx, pp. 88, 89, 139, 140.

*Primary Examiner*—Anton O. Oechsle

*Attorney, Agent, or Firm*—Cushman, Darby & Cushman

[57] ABSTRACT

The invention provides a foolproof way for distinguishing between occasions when beam imbalance is caused by manufacturing inaccuracies and when beam imbalance is caused by presence of a counterfeit coin among the coins being weighed in any one of the three weighings needed for a demonstration of the classical solution of the well-known twelve coins weighing problem using equipment of modest cost. According to the invention, the demonstration equipment is modified so as to include a compensator element which when placed at an indicated location upon the high side of the balance beam in any one of the three weighings which cause noticeable swinging of the balance beam only if there are only genuine coins being weighed in the respective weighing.

5 Claims, 3 Drawing Figures

2
60
42
40
48
32
46
44
29
62R
16
20
3
22
34
36
38
10
26
24
18
14
62L
12
30
HF 42
16
60
62R
20
38
29
62L 24
74
20
38
72
76
16
28
70

COMPENSATOR FOR BEAM OF BALANCE SCALE OF COUNTERFEIT COIN-IDENTIFICATION GAME

BACKGROUND OF THE INVENTION

There is a well-known game of logic in which the subject is presented with a beam-type balance scale and twelve coins, each of which seems to be of the same color, texture, size and weight as the others. In fact, one of the coins is somewhat heavier or lighter in weight than each of the other eleven. The object of the game is to determine, in no more than three weighings, both which coin is the odd one and whether it is heavier or lighter in weight.

In the paperback book *More Games for the Super-Intelligent,* by James F. Fixx, 1SBN 0-445-04144-5, a typical statement of this game of logic is set forth on pages 88 and 89, and on pages 139 and 140 a typical classical solution is given.

Also of interest is the U.S. patent of Wilcox, U.S. Pat. No. 4,014,550, issued Mar. 29, 1977. Although this patent primarily relates to an electronic version of the game, the classical version is set forth at column 1, lines 15–23 and column 2, lines 26–29 (the problem) and at column 4, lines 25–29 (the solution).

A particular balance for use in conducting the game is shown in the U.S. patent of Dunson, U.S. Pat. No. 3,424,455, issued Jan. 28, 1969. In this patent, it is proposed that the imbalance that could result from uneven placement of the two sets of coins along the opposite sides of the balance be minimized or negated by providing each arm of the balance at its outer end with an upwardly open cylindrical cup so that the coins in each set are stacked up on each arm just like a stack of poker chips.

The present invention has found it to be impossible to demonstrate the classical logical solution to the twelve coins problem using any practical available equipment. The difficulty encountered stems from the fact that in practice, unless expensive, precision equipment is used, the balance beam itself may not rest level on the fulcrum, the sites where the coins are to be placed on the two arms of the balance beam may not be exactly symmetrically located, and among the eleven "genuine" coins, which are nominally identical in weight, there are individual and unavoidable slight discrepancies.

As a result, in trying to demonstrate the classical solution to the problem with equipment of modest cost, it is impossible to tell, whether the beam is apparently imbalanced when it has a like number of coins on each arm or whether the set on the lower side includes a heavier counterfeit coin, or the set on the higher side includes a lighter counterfeit coin, or both sets include only "genuine" coins, but a random accumulation of individual deviations due to slight manufacturing variations has produced the seeming imbalance when, for the sake of the game, the beam should appear to be balanced.

SUMMARY OF THE INVENTION

The invention provides a foolproof way for distinguishing between occasions when beam imbalance is caused by manufacturing inaccuracies and when beam imbalance is caused by presence of a counterfeit coin among the coins being weighed in any one of the three weighings needed for a demonstration of the classical solution of the well-known twelve coins weighing problem using equipment of modest cost. According to the invention, the demonstration equipment is modified so as to include a compensator element which when placed at an indicated location upon the high side of the balance beam in any one of the three weighings will cause noticeable swinging of the balance beam only if there are genuine coins being weighed in the respective weighing.

The invention provides an entertaining and educational game, which like the seesaw or children's teeter-totter, clearly illustrates the theory of balance, namely, that balance is effected, not only by weight of an object but also by the distance that weight is located from the fulcrum-balancing point.

So it is that the weight related compensator in its predetermined position from the fulcrum exerts a gravitational force sufficient to overcome any manufacturing errors in the genuine coins and tells a player whether or not a counterfeit coin is on the scale, and thus the player is able to avoid a false conclusion, or oppositely, to make a correct conclusion, so necessary to the solution of the game in three weighings.

The principles of the invention will be further discussed with reference to the drawing wherein a preferred embodiment is shown. The specifics illustrated in the drawings are intended to exemplify, rather than limit, aspects of the invention as defined in the claims.

DETAILED DESCRIPTION

Figure 1:
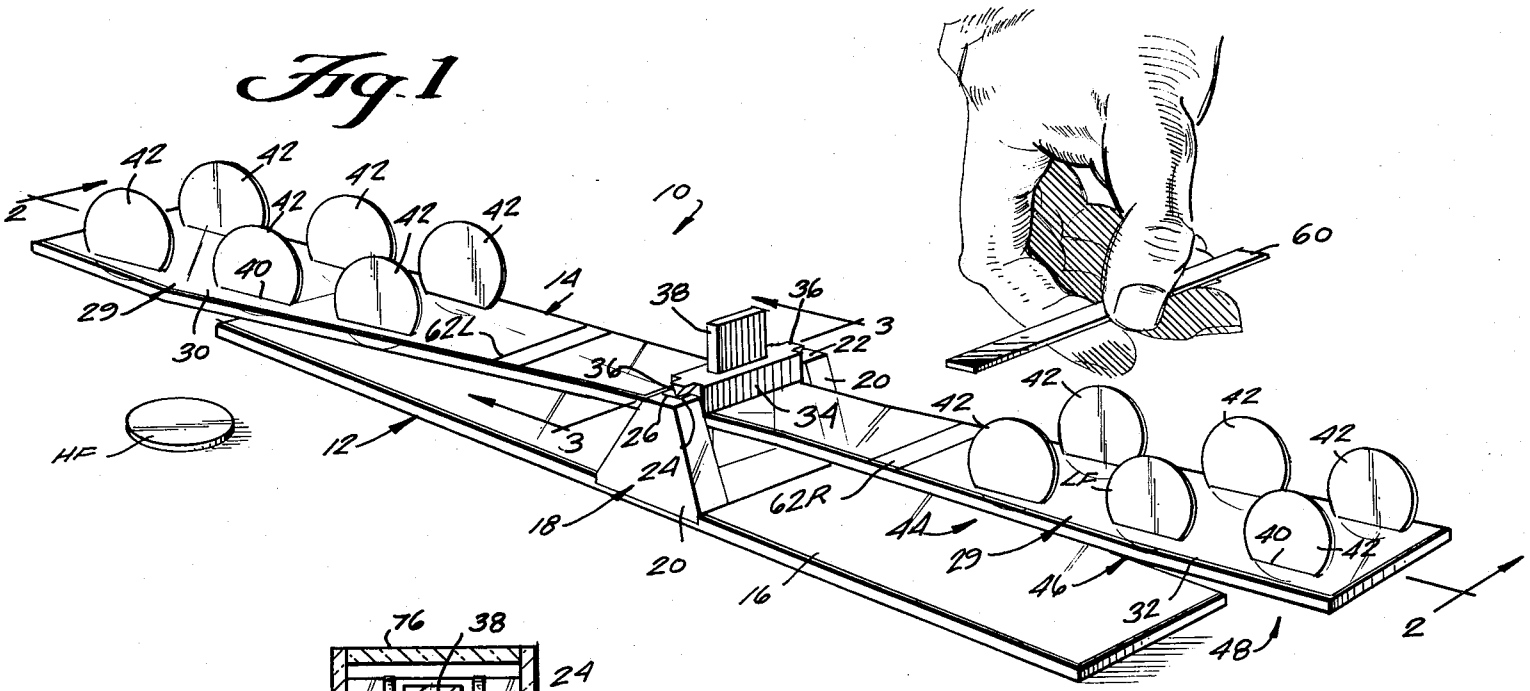
FIG. 1 is a perspective view of a modest cost apparatus for demonstrating the 12 coins/three weighings game of logic, a thireteenth coin being shown lying beside the balance scale and the compensator element being shown being placed on the high side of the scale.

The modest cost balance scale 10 includes two fundamental parts related to one another very much in the same way as the corresponding parts of a seesaw. First there is a stationary base 12 on which a balance arm unit 14 is pivotally balance. The stationary base is shown including a generally horizontal base plate 16 with a centrally located fulcrum portion 18 with two laterally spaced upstanding piers 20, each topped with a respective upwardly facing plate 22, which in the instance depicted includes a medially located, upwardly opening, broad-angled V-shaped notch 24 with a laterally outer end wall 26. The axis of the two notches is aligned crosswise of the scale 10.

Figure 3:
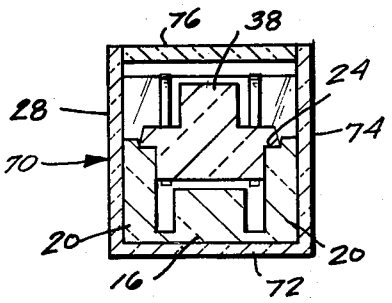
FIG. 3 is a crosswise vertical sectional view on line 3—3 of FIG. 1 of the scale in a carrying case.

The upstanding tab shown centrally located on the base plate 16 between the piers 20 is provided to be gripped between the thumb and forefinger for lifting the base 12 from the scale carrying case 28 (FIG. 3).

The balance arm unit 14 includes a unitary pair 29 of oppositely extending, counterbalanced arms 30, 32, which are sometimes referred to herein as the left arm and the right arm or one arm and an opposite arm, etc. Centrally, where the arms 30, 32 are connected, the balance arm unit is shown provided with an upstanding, crosswise-extending knife-edge portion 34 which includes two respective, generally triangularly shaped, downwardly-pointing knife edges 36, which are located to be individually supported on the respective plate notches 24 of the plates 22 of the piers 20. The included angle of each knife edge 36 is substantially less than the included angle of the respective V-shaped notch 24 so that the balance arm unit 14 is free to pivotally rock back and forth on the fulcrum 18 of the base 12.

Between the knife edges 36, the knife edge portion 34 is shown provided with an upstanding tab 38 to be gripped between the thumb and forefinger for lifting the balance arm unit from the scale carrying case 28 (FIG. 3).

In the preferred embodiment shown the arms of the balance beam 29 are spatulate, generally horizontal plates, each provided at corresponding locations from the fulcrum with a respective field of six upwardly opening detents or slots 40, each shaped to receive and upstandingly support any one of the coins 42.

In the instance depicted, the slots 40 in each field are located in three rows of two including a row nearest the center 44, a middle row and a row nearest the respective outer end 46, 48.

As will be appreciated, in carrying out demonstrations of the classical solution to the 12 coins/three weighings game of logic, in each of the trial weighings, some like number of coins 42 is placed on each arm of the balance beam 29. In the instance depicted in FIG. 1, a full complement of six coins is being weighed on each arm. When, in any other weighing less than all twelve coins are being balanced, they would, of course, be evenly distributed on the two arms, using only comparable slots 40, in view of the multiplier effect that distance along the arm from the fulcrum has on the effect of any weight on the balance beam 29.

Thus, in any weighing, one of three situations is going to be the case:

(1) One side of the scale has only genuine coins 42 on it and the other side of the scale has only genuine coins 42 on it;

(2) One side of the scale has only genuine coins 42 on it and the other side of the scale has only one, lighter-than-genuine counterfeit coin LF on it, with the remainder of the coins on it being genuine; and (3) One side of the scale has only genuine coins 42 on it and the other side of the scale has only one, heavier-than-genuine counterfeit coin HF on it, with the remainder of the coins on it being genuine.

Figure 2:
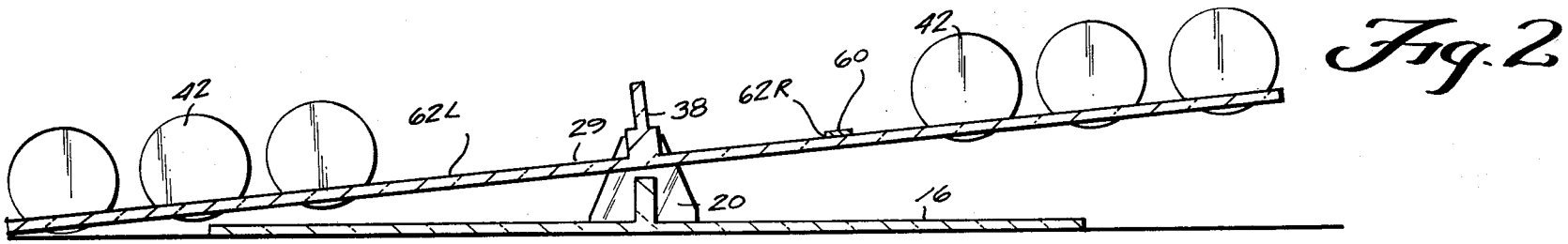
FIG. 2 is a lengthwise vertical sectional view on line 2—2 of FIG. 1, with the compensator element in place.

If the situations were ideal, in case (1), the balance beam would be absolutely horizontal, in case (2), the balance beam would be slanted, with the arm having only genuine coins tipped down (as in FIGS. 1 and 2), and in case (3), the balance beam would be slanted, with the arm having only genuine coins tipped up.

The trouble comes when the situations are not ideal. The demonstration equipment 10 is intentionally made at modest cost, e.g. the units 12 and 14 may each be injection molded as a single piece from conventional plastic material such as styrene, or fabricated of cut and glued pieces of wood or acrylic plastic sheeting. In such cases, even when there are no coins on the scale, the balance beam 14 may be tipped somewhat. For the same reason, even when there are only genuine coins resting in corresponding slots on opposite arms of the balance beam the balance beam 14 may be tipped somewhat.

Thus the problem addressed by the present inventor is how to distinguish between the scale imbalance due to the presence of a counterfeit coin somewhere in a slot on the balance beam and scale imbalance due to imprecision in manufacture of the scale or the coins.

This is not just a matter of zeroing the balance arm by shifting a small weight along it until it was horizontal before any coins are put on it; that would compensate for maldistribution of the weight of the balance beam, but it would not compensate for non-uniform placement of the slots 40, nor for non-uniform weights among and weight distribution within the respective genuine coins.

The present inventor has found that there is a solution to this problem, of providing a demonstration apparatus of moderate cost, for the special case where the cumulative effect on the balance beam of the manufacturing inaccuracies are less than that caused by the difference in weight of a counterfeit coin.

A clarifying word about the coins 42 is here in order: although actual coins might be used, in practice, what is most likely to be used as "coins" are metal or plastic disks which look and feel alike and are so close in weight that a normal person cannot put one in each hand and be able to tell whether one hand is holding a heavier coin than the other. This may be done, e.g. by making eleven of the coins out of steel to provide the "genuine" coins, and then providing a heavier-than-genuine coin made out of copper, or a lighter-than-genuine coin made out of zinc. The coins may be conventionally coated or plated with a like coating or plating metal, so that each looks and feels like all the others. For any particular demonstration, only one fake coin would be included in the set of twelve.

The improvement provided by the present inventor is to provide a compensator element 60, here shown in the form of a matchstick-sized and shaped flat strip of metal, and to provide a set of marks 62L, 62R, on the balance beam, at corresponding locations between the fulcrum and the respective fields of notches 40, for indicating where the compensator element 60 is to be placed.

Accordingly, when empolying the compensator element 60 of the present invention, the classical solution to the twelve coins/three weighings problem is modified as follows:

In each weighing, after an equal number of coins is placed on each arm of the balance beam, in corresponding slots, the balance beam will assume a tilted condition. In order to determine whether this imbalance is due to there being a counterfeit coin among those being balanced, the compensator element is simply placed on the balance beam, upon whichever of the mark sets 62L, 62R is on the apparently lighter (i.e. upper) arm.

If at this time nothing happens, and the arm that was up stays up, then one can be certain that there is a counterfeit coin on the balance beam. However, if at this time the balance beam reverses its tilt, so that the arm that was tipped-up (the arm on which the compensator element was placed) tips down, then one can be certain that there are only genuine coins on the scale.

Accordingly, a demonstration may be made of the classical solution to the twelve coins/three weighings problem, even though the equipment is of modest cost.

In order to further disclose a best mode currently contemplated, a practical example will be given. However, it should be understood that the amounts and materials are given only by way of example.

In the set of coins, the heaviest one is a "counterfeit" coin made of plated copper, the eleven "genuine" coins are made of plated steel and each weighs 89.7 percent as much as the heavy counterfeit, and the lightweight "counterfeit" coin is made of plated zinc weighing 89.6 percent as much as one of the "genuine" coins.

The compensator element is a flat rectangular bar of stainless steel about 0.013 inch thick, 0.125 inch wide and 2.5 inches long.

The present inventor ascertained the proper relative weight and location of the compensator element by placing it on the high side of the balance beam when weighing only genuine coins and moving it gradually toward the outer end of that arm, away from the fulcrum. At the location where the compensator element, when present, would noticeably move the beam by tipping the balance beam down on its formerly upper side, the set of marks 62L (or 62R) was placed, and a correspondingly located set of marks 62R (or 62L) was placed on the opposite side.

As a check, the inventor weighed one to five genuine coins with a heavier, then a lighter counterfeit coin, against an equal number of coins, each time placing the compensator element 60 on the respective set of marks 62L or 62R on whichever side of the balance beam was tipped up. As desired, in no instance did placing the compensator element 60 on the respective set of marks make any difference; the balance beam side that was tipped up without the compensator element being placed on it remained tipped up after the compensator element was placed on it.

Although by preference the sets of marks 62L, 62R are located between the fields of coins and the fulcrum, it should be obvious that where the compensator element 60 is relatively lighter, the locator marks 62L, 62R can be placed further out, e.g. within the fields of coins or between the fields of coins and the respective outer ends of the balance beam arms, but always at corresponding locations on the two arms.

The preferred carrying case shown in FIG. 3 is a box-like unit having a body 70 with a floor 72 and sidewalls 74, and a removable lid 76. The floor 72 may be provided with upstanding ridges for preventing endwise sliding of the scales 10 when it is located in the box. The most dramatic visual effect is achieved where the box is made of transparent plastic material, and it is of such a height that when the scales is in the box and the box cover is in place, the box cover engages the coins on the high side, pushing them down just enough that, viewed through the box, a balance beam seems to be level. There is room for the compensator element in the box.

Other means than notches could be provided for facilitating uniform placement of the coins on the two arms of the balance beam. For instance, graphical outlines or physical outlines characterized by circular ridges or wells into which the respective coins are to be deposited could be provided to like effect.

The compensator element 60 need not have the shape shown; it could also be coin-shaped (but looking obviously different from the others), or it could be shaped like a miniature piece of paper currency, or it could be made to hang from a hook provided as the respective set of marks on the respective arm. A thin nylon string could be used to tie the compensator element to the base with sufficient slack to allow the compensator to be placed on either arm of the balance, and to be set aside when not in use.

It should now be apparent that the compensator for beam of balance scale of counterfeit coin-identification game as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A modest cost apparatus for demonstrating the classical solution to the twelve coins/three weighings problem, where one of twelve coins, a "counterfeit", is substantially but not perceptably different in weight from the individual weight of each of eleven "genuine" coins, though of the same appearance, and the object is to single-out the counterfeit coin and to determine whether it is heavier or lighter than a said genuine coin, said apparatus comprising, in addition to a set of twelve such coins:

a balance scale including a base with a fulcrum, and a two-armed balance beam pivotally supported on the fulcrum of the base;

means on each balance beam arm designating corresponding sites for placement of six of the coins;

means marking a corresponding site on each balance beam arm for disposition of a compensator element on the balance beam; and a compensator element of such relative weight to each of the coins as to have these characteristics:

that when there is a corresponding number from one to six of correspondingly located ones of said coins placed at respective ones of said sites on said balance beam arms, and said balance beam has assumed a tilted disposition so as to have a high side, and said compensator element is disposed on the high side of the balance beam at said corresponding marked site, the balance beam pivots and oppositely tips down, so that what was the high side becomes the low side only when all of the coins then disposed on the balance beam are "genuine" coins, but the balance beam remains tilted so that what was the high side remains the high side only when one of the coins then disposed on the balance beam is a "counterfeit" coin.

2. The apparatus of claim 1, wherein:

the eleven "genuine" coins are made of steel and the "counterfeit" coin is made of a non-ferrous metal and all of the coins in the set are plated to look alike.

3. The apparatus of claim 2, wherein:

the set of coins further includes a thirteenth coin which is a second "counterfeit" coin having the opposite weight relation to the "genuine" coins than the first-mentioned "counterfeit" coin so that the two "counterfeit" coins can be alternatively used in demonstrations using the apparatus.

4. The apparatus of claim 1, wherein:

the base and the balance beam are each formed of an integral molding of synthetic plastic material.

5. The apparatus of claim 4, further including:

a transparent case for the balance scale, set of coins and compensator element which, when housing these, holds the balance beam level.

* * * * *